United States Patent [19]

Kupsky

[11] 4,111,028

[45] Sep. 5, 1978

[54] METHOD AND APPARATUS FOR FABRICATING RETICULAR SHEET MATERIAL

[76] Inventor: Frederick E. Kupsky, 1300 E. Algonquin, Apt. 2G, Schaumburg, Ill. 60195

[21] Appl. No.: 821,630

[22] Filed: Aug. 4, 1977

[51] Int. Cl.[2] ..... B21D 31/02

[52] U.S. Cl. ..... 72/324; 72/187; 29/163.5 R

[58] Field of Search ..... 72/324, 325, 186, 187; 29/163.5; 113/1 C, 118 R

[56] References Cited

U.S. PATENT DOCUMENTS

| | | | |
|---|---|---|---|
| 1,983,412 | 12/1934 | Smith | 29/163.5 R |
| 2,828,843 | 4/1958 | Hill | 72/324 |
| 3,455,135 | 7/1969 | Allen | 72/187 |

*Primary Examiner*—Lowell A. Larson

*Attorney, Agent, or Firm*—Richard H. Anderson

[57] ABSTRACT

An improved method and apparatus for fabricating reticular sheet material utilizes dies for shearing a sheet of metal into interconnected strands, mandrels for bending alternate interconnections of the metal in opposite directions to form ridges and valleys between the strands, and inserting punches into the sheared areas between strands while holding the ridges with other punches to form uniform openings in the areas between the strands.

11 Claims, 8 Drawing Figures

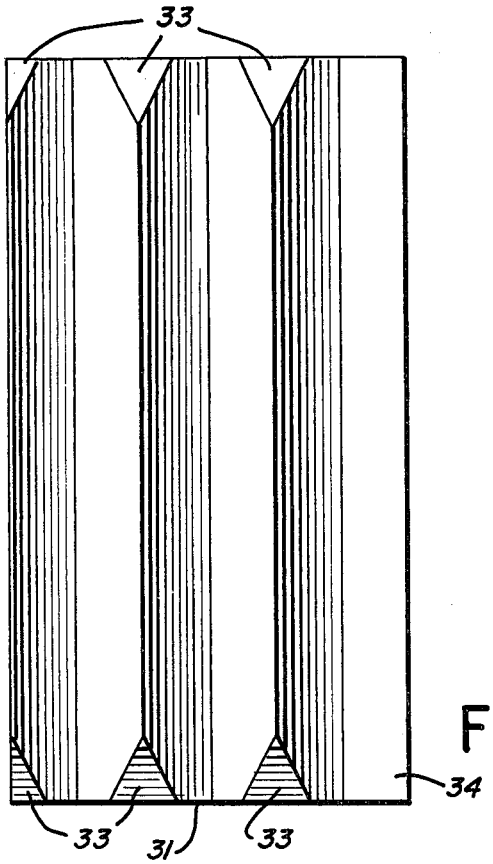
FIG. 3
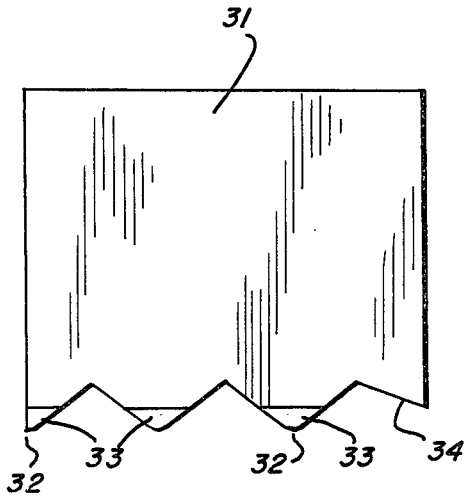
FIG. 2
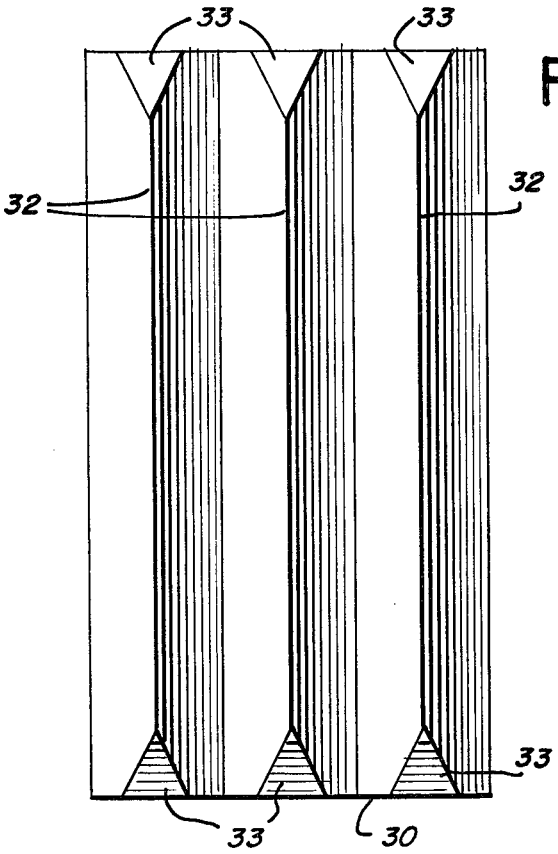
FIG. 4
FIG. 5
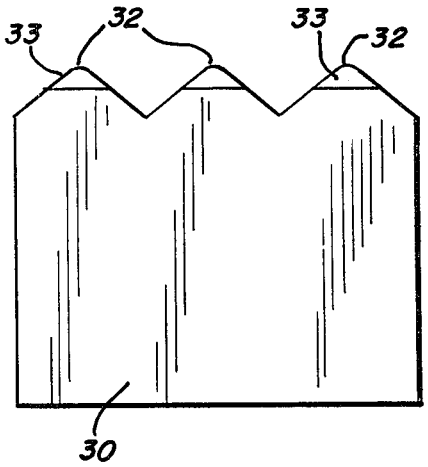

FIG. 6
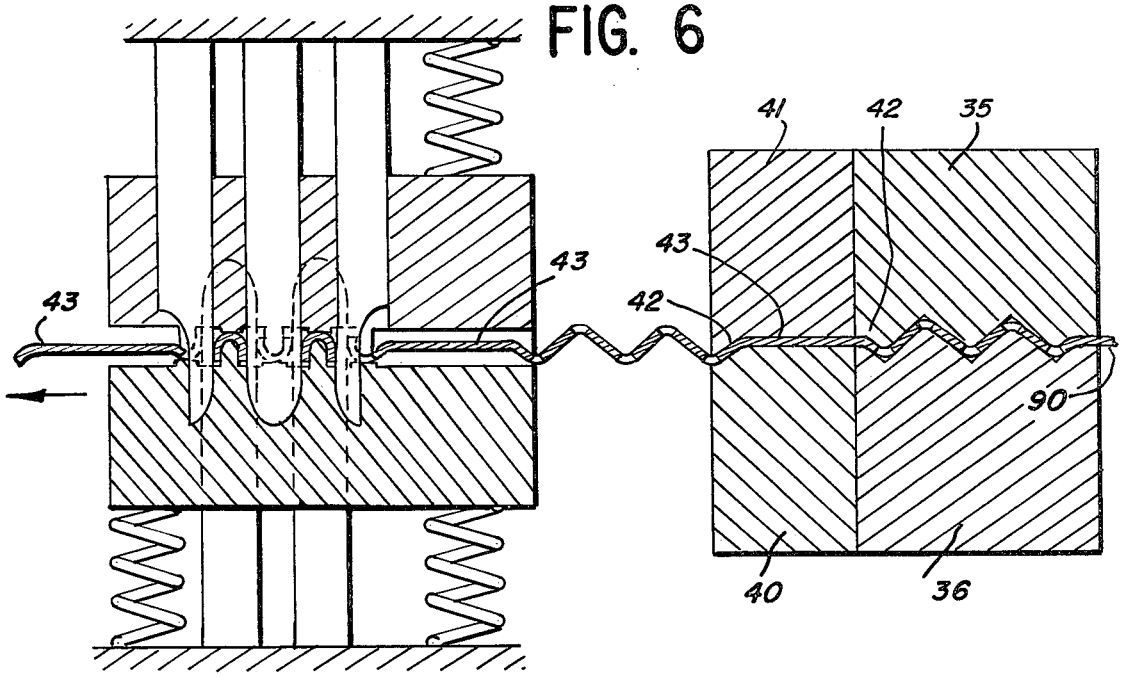
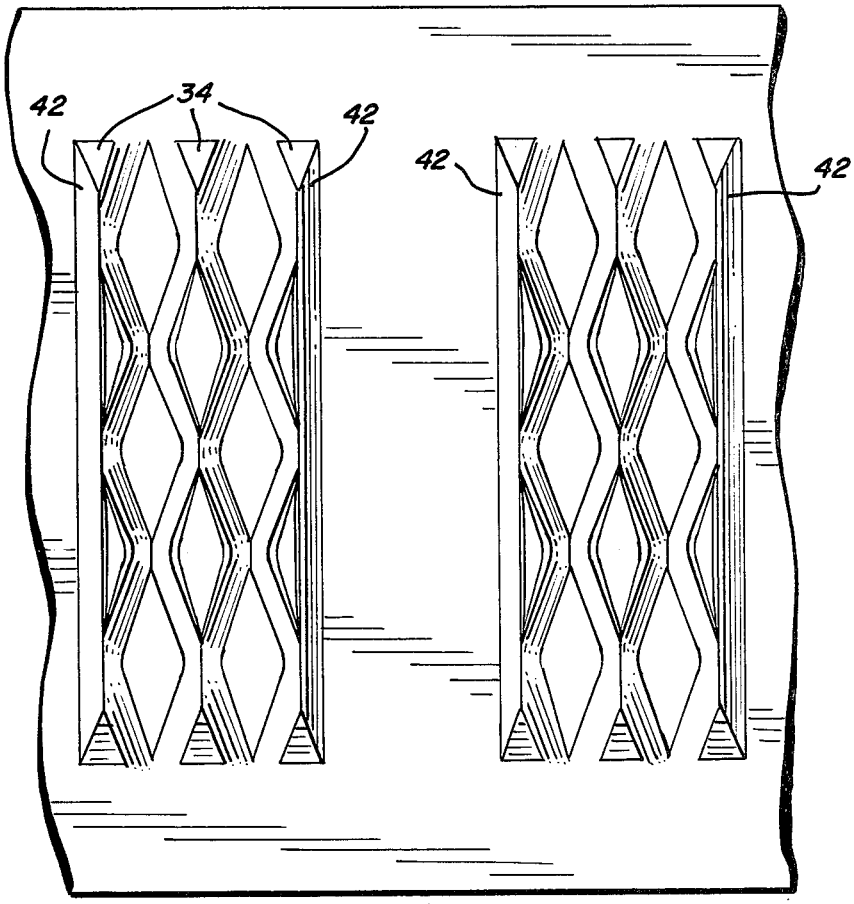
FIG. 7
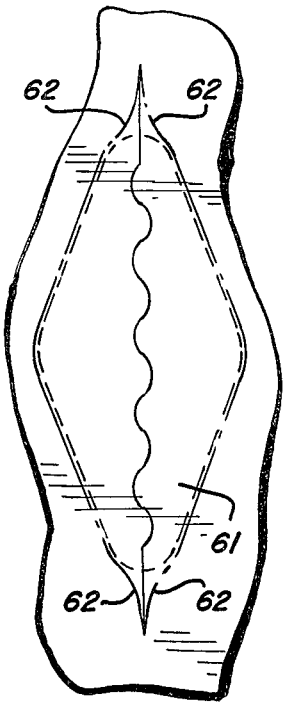
FIG. 8

METHOD AND APPARATUS FOR FABRICATING RETICULAR SHEET MATERIAL

BACKGROUND OF THE INVENTION

1. Field of the Invention

This invention relates generally to reticulated sheet material, commonly referred to as grating, and more particularly, to a method and apparatus for fabricating such reticulated sheet material.

2. Description of the Prior Art

Grating is well known, and can be categorized into two basic types. One type is essentially a stamping formed by a set of dies that impart a three-dimensional contour and usually drainage holes into a sheet of mechanically workable material. The basic limitation of this type is that the depth of the grid is usually limited, thus limiting the strength of the structure.

The other type is a reticular network grid material similar in configuration to the structure described in U.S. Pat. Nos. 2,828,792 and 2,828,843. A characteristic of the reticular network grid is that the grid can be formed with relatively deep members. Thus, steps and other supports fabricated from such a grid structure are thus quite strong and suitable for industrial pedestrian traffic.

While a reticular network grid is a stronger structure than a stamping, the presently available reticular grids exhibit several inherent deficiencies caused by the fabricating apparatus and the method of fabrication. Firstly, most grids exhibit irregularly shaped openings that are usually asymmetrical in configuration. The strands that form the opening are commonly tipped so that the center line of the opening deviates from its intended vertical orientation, and the strands usually do not reach a uniform level. Excessive tearing at the interconnections between the strands is common, as is a nonuniformity in the shape of the ridges that interconnect the strands. In addition, the currently used method and apparatus for fabricating the grid structures puts an undue strain on the material being worked, thus requiring the use of relatively thin materials with easy cold working characteristics, and limits the sizes of openings and grid pattern shapes that may be achieved without causing undue strain on the material during the fabrication process.

SUMMARY OF THE INVENTION

Accordingly, it is an object of the present invention to provide a new and improved method and apparatus for fabricating reticular metwork grid material that overcomes many of the problems associated with the prior art methods and apparatus.

It is a further object of the present invention to provide a method and apparatus for fabricating a more uniform reticulated grid structure that can be achieved by the prior art methods.

Yet another object of the present invention is to provide a method and apparatus for fabricating reticulated grid structures that generates less strain in the material being worked than do prior art methods and apparatus.

It is still another object of the present invention to provide a method and apparatus for fabricating an improved reticulated grid structure that is stronger than the prior art structures and exhibits less undesirable cracking and tearing of the grid material.

The present invention comprises a method and apparatus that forms a reticulated grid structure in several steps. Firstly, a set of punches and dies shears a pattern of separate interconnected strands in a sheet of mechanically formable material such as steel. Subsequently, the material interconnecting the strands is bent by a pair of mandrels to form alternate longitudinal valleys and ridges between strands. Next, stationary ridge punches serving as mandrels under each set of ridges close over the ridges and hold them in place while cooperating opening-form punches enter the sheared areas between the strands and force the strands into spaces between the ridge punches and the opening-form punches to form the openings between the strands. Optionally, a second set of stationary ridge punches and cooperating shape-form punches may be used to set the final contour of the openings according to the contour of the shape-form punch.

The contours of the shape-form punches are designed to set the contour of the central portion of the opening, but the shape-form punches are made shorter than the full length of the opening. Such a design allows forces acting on the strands to be balanced along the strand and minimizes the stress at the point where two strands are joined, thus minimizing the tendency of the material to tear. Also, the opening-form and the shape-form punches can be combined into a single punch when the cold working characteristics of the sheet material allow such a single step operation. Finally, a set of interspaced mandrels may be incorporated between the above-mentioned mandrels and punches to form other panels integrally with the reticular grid for utilitarian or decorative purposes.

BRIEF DESCRIPTION OF THE DRAWING

The above and other objects and advantages and novel features of the present invention will become apparent from the following detailed description of a preferred embodiment of the present invention illustrated in the accompanying drawings wherein:

FIG. 2 is an elevational view of the upper ridge forming mandrel;

FIG. 3 is a plan view of the upper ridge forming mandrel;

FIG. 4 is a plan view of the lower ridge forming mandrel;

FIG. 5 is an elevational view of the lower ridge forming mandrel;

FIG. 6 is a cross section of selected stages of the apparatus modified to show the method of fabricating interspaced flat or embossed, solid or perforated panels between reticular grid panels constructed in accordance with the principles of the present invention;

FIG. 7 shows the surface appearance of a portion of a sheet of material with a flat panel interspaced between panels of reticular grid material; and FIG. 8 is a cross sectional view of the contour of a particular shape-form punch and the contour of the opening it forms, illustrating the residual contour between the radius of the punch and the root of the sheared segment.

DESCRIPTION OF THE PREFERRED EMBODIMENT

Figure 1:
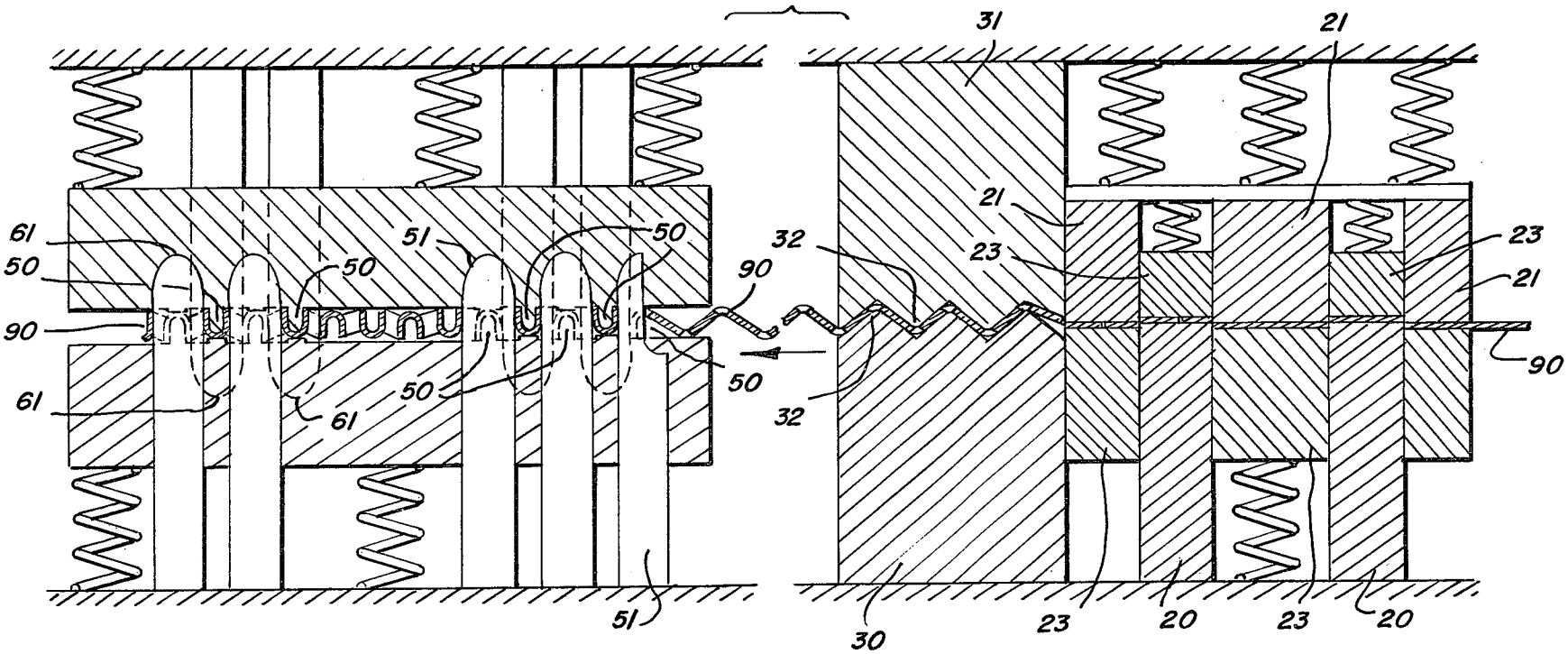
FIG. 1 is a cross section through the apparatus showing a typical workpiece in the several stages of fabrication constructed in accordance with the principles of the present invention.

Referring to the drawing, with particular reference to FIG. 1, there is illustrated a new and improved apparatus for making a reticular grid sheet material from a mechanically formable material constructed in accordance with the principles of the present invention. The first stage of the apparatus utilizes a punch and die set including punches 20 and dies 21 which shear the material 90 into a pattern of transverse strands. Each row of punches 20 and dies 21 may contain one or more punch units depending on the number of openings desired. Gaps may be interposed between rows of punches if segments of unformed material are desired between rows of openings in the finished product. Alternate rows of punches 20 and dies 21 have their punch and die units offset by one-half the center-to-center distance between holes in the finished product, and alternate rows of punches 20 contain one fewer punch unit than the rows adjacent thereto. Strippers 23 are used to remove the formable material 90 from the punch and die sets 20 and 21 after the shearing process.

In accordance with an important feature of the present invention, a pair of forming mandrels 30 and 32 embody ridges 32 to bend the material 90 in such a manner to make the bend radius between strands equal to the final bend radius, thus eliminating further working of those areas. A beveled portion of the mandrel 33 (FIGS. 2–5) together with the adjoining ridge forms a trough 34 (FIG. 7) in the unsheared material at the ends of the ridges.

Also, the mandrels 30 and 31 controllably space the ridges formed in the material interconnecting the previously sheared strands, thus forming a ridged structure having level and true rows of ridges interconnected by metal segments formed to the final arc desired. Further, the mandrels 30 and 31 positively position the ridges with respect to the plane of the border material, and retain the material in place during subsequent forming operations to assure uniform spacing between the openings of the finished product. The top mandrel 31 (FIG. 2) is designed with a relieved edge 34 on the entry side to facilitate the transition of the flat workpiece from the unformed to the formed stage.

In accordance with another important feature of the present invention, an optional pair of mandrels 40 and 41 (FIG. 6) may be employed with a pair of ridge forming mandrels 35 and 36, similar to the mandrels 30 and 31, to interspace a flat or embossed panel 43 between panels of a reticular grid. The two sets of mandrels 35, 36 and 40, 41 cooperate to form a symmetrical bend in the interspaced flat or embossed, solid or perforated panel to create a suitable transition 42 from the level of the ridge to the level of the border material or other level desired. A modular width equal to the width of the reticular grid panel establishes a feed length for the workpiece to which all the other stages of the apparatus are adjusted, and results in a repetitive pattern as shown in FIG. 7.

In accordance with a further important feature of the present invention an assembly of cooperating stationary ridge punches 50 and opening-form punches 51 open the sheared portion of the workpiece. An assembly of cooperating stationary ridge punches 50 and shape-form punches 61 set the final contour of the opening (FIGS. 5 and 6). The shape-form punch 61 is shorter than the length of the sheared portion of the workpiece, and the contour of the shape-form punch 61 is designed to control the contour of the central area of the opening while allowing the ends of the opening to follow a balance of the stress-strain forces into a residual contour 62. The selected configuration of the shape-form punch 61 can be varied to suit the size and shape of the desired opening within the sheared area. The shortened shape-form punch design permits the fabrication of materials that do not lend themselves to severe cold-working stress by reducing the stresses near the ends of the sheared areas. Further the design of the shape-form punches 61 allows the opening-form punches 51 to have a simple shape, a cylinder for example, and thus be inexpensive to fabricate. The shape-form punches 61 that are employed in a following stage can impart a variety of final contours to the opening for utilitarian or decorative purposes without having to have a complex compound shape because the sheared area has already been fully opened even through not fully shaped. For materials that are readily cold worked, the shape-form punches 61 may be substituted for the opening-form punches 51 and the opening-form punches 51 eliminated.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Apparatus for forming a reticulated grid structure comprising:

means for shearing into a workpiece a plurality of slits coaxially disposed in a plurality of parallel rows to form a plurality of interconnected strands;

means for bending said workpiece along the axis of each row of slits to form a ridged structure of corrugations having peaks and valleys at high and low points of said bent interconnected strands said corrugations being coaxial with the slits, having said slits disposed at the peaks and valleys thereof; and means for insertion into said slits for displacing the portions of said strands adjacent to said slits to form openings therebetween.

2. Apparatus as recited in claim 1 wherein said strand portion displacing means includes a plurality of spaced punches each associated with predetermined ones of said slits, each punch having a dimension extending in a direction along the direction of elongation of said associated slits that is shorter than said associated slits.

3. Apparatus as recited in claim 2 wherein said punches have diamond shaped cross sections.

4. Apparatus as recited in claim 1 wherein said bending means includes means for retaining said workpiece in place during the insertion of said displacing means.

5. Apparatus as recited in claim 1 further including second means for insertion into said openings for further displacing the portions of said strands adjacent to said openings to alter the shapes of said openings.

6. Apparatus as recited in claim 5 wherein said strand portion displacing means includes a plurality of spaced punches each associated with predetermined ones of said slits, each punch having a dimension extending in a direction along the direction of elongation of said associated slits that is shorter than said associated slits.

7. Apparatus as recited in claim 6 wherein said punches have diamond shaped cross sections.

8. Apparatus as recited in claim 1 wherein said displacing means includes means for supporting the portion of said peak and valleys between said slits during the insertion of said displacing means into said slits.

9. A method for forming a reticulated grid structure comprising:

forming within a workpiece a plurality of spaced elongated slits coaxially disposed in a plurality of parallel rows to form a plurality of interconnected strands;

bending said workpiece between said strands along the axis of each row of coaxially disposed slits to form corrugations in said workpiece having adjacent peaks and valleys, to thereby form a ridged structure having said slits disposed coaxially with said formed corrugations at the peaks and valleys thereof; and inserting punches into said slits to displace the portions of said interconnected strands surrounding said slits to form openings between said interconnected strands.

10. The method recited in claim 9 further including the step of inserting a second set of punches into said openings to alter the shape of said openings.

11. The method recited in claim 9 further including the step of supporting the workpiece while inserting said punches to restrain movement of said workpiece during the punch inserting operation.

* * * * *